United States Patent [19]

Figueroa

[11] Patent Number: 4,499,529

[45] Date of Patent: Feb. 12, 1985

[54] LIGHT REFLECTOR

[76] Inventor: Luisito A. Figueroa, 2275 Taft Ave., Malate, Manila, Philippines

[21] Appl. No.: 526,216

[22] Filed: Aug. 24, 1983

Related U.S. Application Data

[63] Continuation of Ser. No. 265,828, May 21, 1981, abandoned.

[51] Int. Cl.[3] ..... F21V 7/00

[52] U.S. Cl. ..... 362/283; 362/217; 362/277; 362/281; 362/290; 362/301; 362/302; 362/319; 362/321; 362/323; 362/325; 362/342; 362/346

[58] Field of Search ..... 362/217, 277, 279, 281, 362/283, 290, 301, 302, 319, 321, 323, 325, 342, 346

[56] References Cited

U.S. PATENT DOCUMENTS

| | | | |
|---|---|---|---|
| 3,700,877 | 10/1972 | Wilson | 362/342 |
| 3,829,677 | 8/1974 | DeLlano | 362/346 |
| 3,860,903 | 1/1975 | Van Steenhoven | 362/279 |

FOREIGN PATENT DOCUMENTS

| | | | |
|---|---|---|---|
| 54618 | 12/1890 | Fed. Rep. of Germany | 362/342 |
| 177184 | 1/1954 | Fed. Rep. of Germany | 362/342 |

*Primary Examiner*—Donald P. Walsh

*Attorney, Agent, or Firm*—Thomas E. Schatzel

[57] ABSTRACT

A light reflector for specific use in combination with an elongate light source such as a fluorescent lamp. It has a plurality of reflecting surfaces disposed behind and symmetrically of the light source and includes opposed central tangent reflecting surfaces. The cumulative effect of the reflecting surfaces is to synthesize the light rays emitted upwards with those emitted downwards by the sourve towards the area to be lighted.

7 Claims, 6 Drawing Figures

LIGHT REFLECTOR

This application is a continuation of application Ser. No. 265,828 filed May 21, 1981, now abandoned.

BACKGROUND OF THE INVENTION

This invention relates generally to the field of illumination devices and more specifically, to a reflector for an elongate light source such as a fluorescent bulb.

Light emitted by an elongate fluorescent bulb tends to be emitted in all directions. Thus, when it is mounted on a ceiling, it radiates light upwardly where it is wasted. Reflectors have been used primarily to collect the wasted light and direct it downwardly towards the area to be lighted to increase the illumination efficiency of the light source.

An ideal reflector for the aforesaid light source should be capable of collecting all the light emitted upwards by the source, direct it accordingly within the lateral boundaries of the area to be lighted. Known reflectors fail in this aspect. Some cannot adequately reflect the light rays emitted at high angles permitting it to exceed the lateral boundaries of the area to be lighted. Others tend to concentrate the light to a particular section of the area, reducing the apparent uniformity of illumination of such area, thus causes glare.

Being substantially rigid, these reflectors have one pronounced inherent structural deficiency. They have a fixed focal axis and a fixed effective illumination area. To vary the direction of the light, these reflectors have to be moved relative to the light source. This would require sophisticated mounting means.

SUMMARY OF THE INVENTION

In accordance with the present invention, the light reflector has a plurality of light reflecting surfaces inclined towards the light source and capable of directing the light rays downwardly and uniformly over a greater area. The light reflecting surfaces may be fixed and in which cases, the angular dispositions of each of the surfaces are accurately predetermined. In another embodiment proposed by the invention, the reflecting surfaces are individually tiltable and adjustable to reflect substantially all the light emitted towards and within the lateral boundaries of the area to be lighted. An important feature of the invention are a pair of opposed tangential reflecting surfaces disposed centrally of the inclined light reflecting surfaces which minimizes the amount of reflected light hitting back the light source. This maximizes the illumination rendered by said source.

The reflecting planar surfaces are positioned symmetrically and coextensively of the elongate light source. They are pivotally mounted and define a generally slightly concave contour. The reflecting surfaces are suitably coated or otherwise prepared to effectively intercept and reflect light emitted by the light source. The reflecting surfaces could be alumnized, silvered or coated with chrome deposition to provide a good reflecting surface.

The use of the reflector proposed by the invention results in great savings of electrical energy. Actual tests conducted shows that three 40-watt fluorescent bulbs using the reflector can approximate the illumination power of a four 40-watt bulbs without a reflector. Consequently, the number of lighting costs for a particular working area can be drastically reduced with the use of the reflector.

The light reflector in accordance with the invention will be more fully understood by making reference to the following detailed description of the preferred embodiments as illustrated in the accompanying drawings.

Figure 2:
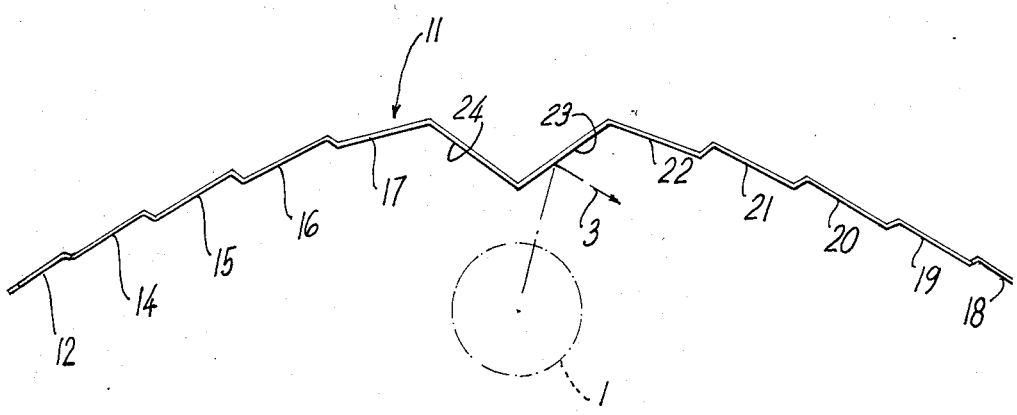
FIG. 2 is a side elevational view of the light reflector shown in FIG. 1.
Figure 1:
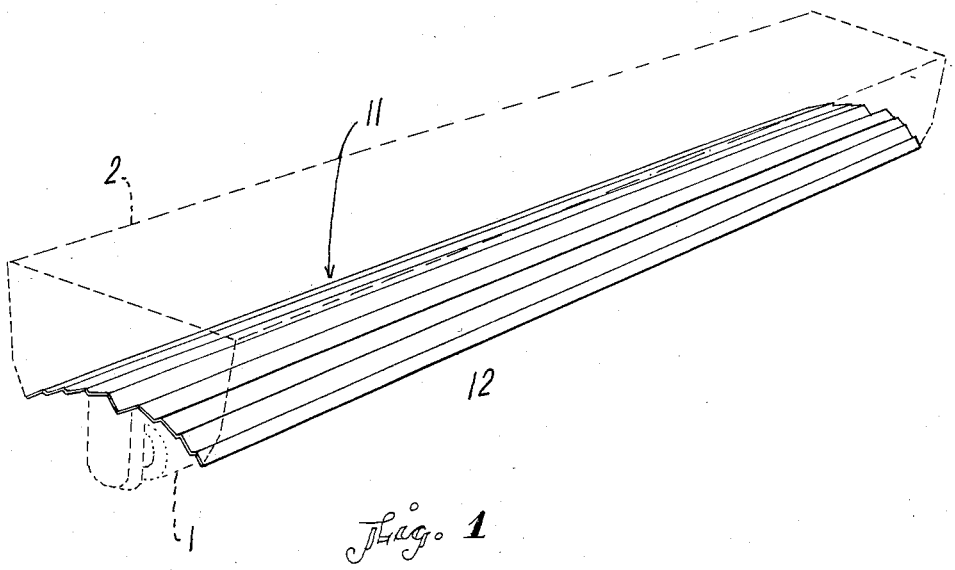
FIG. 1 is a perspective view of a light reflector in accordance with the invention.
Figure 3:
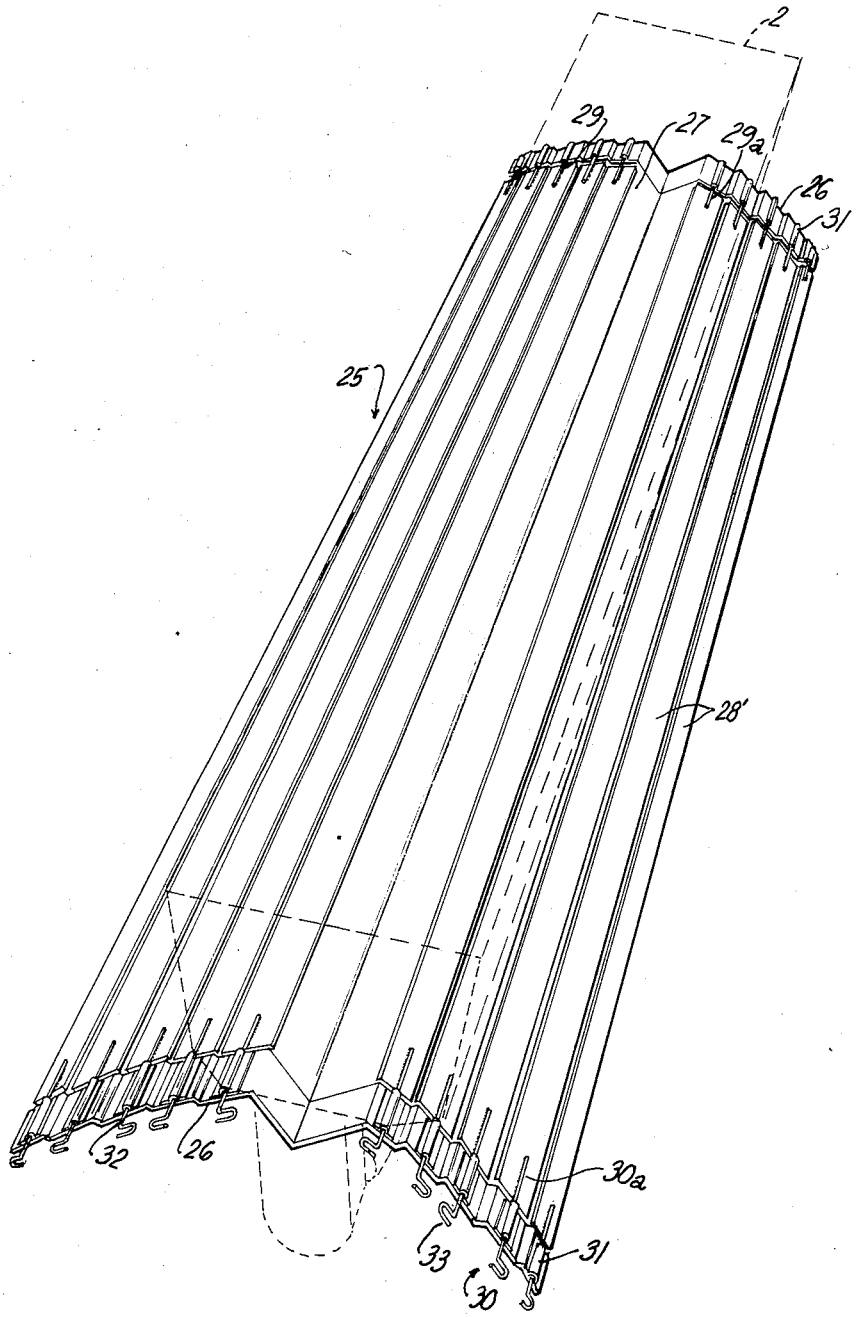
FIG. 3 is a top perspective view of another embodiment of the invention.
Figure 4:
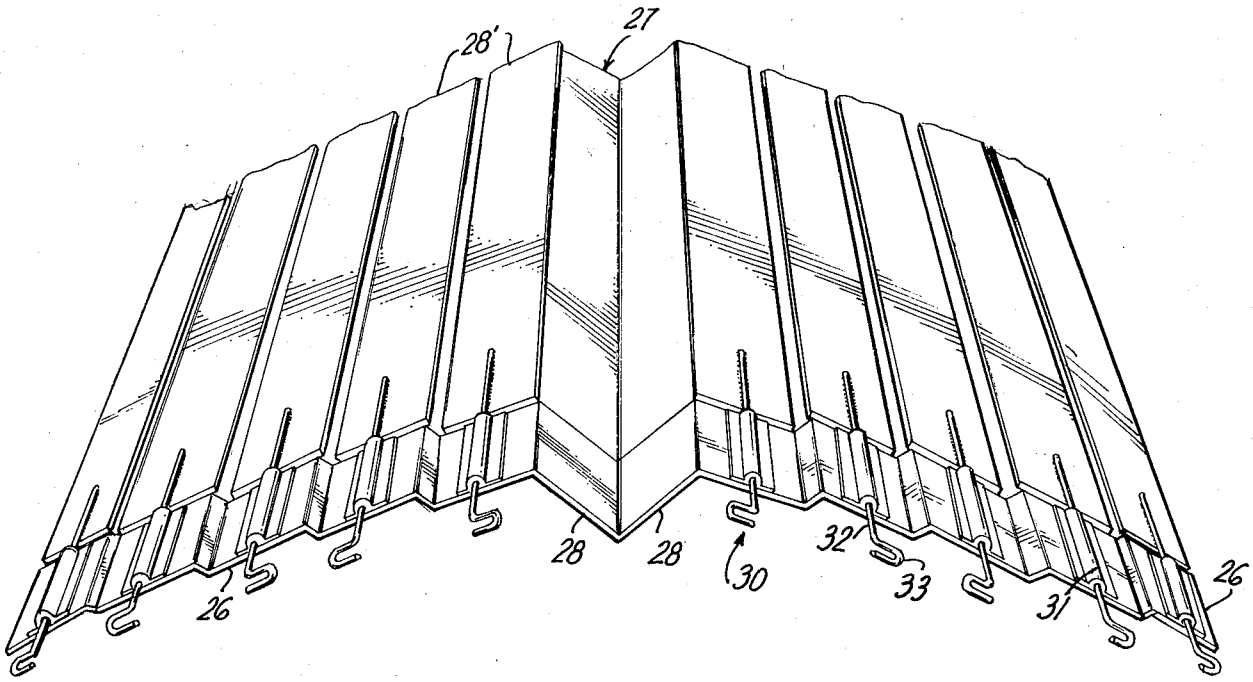
FIG. 4 is an isolated enlarged end view of the light reflector shown in FIG. 3.
Figure 5:
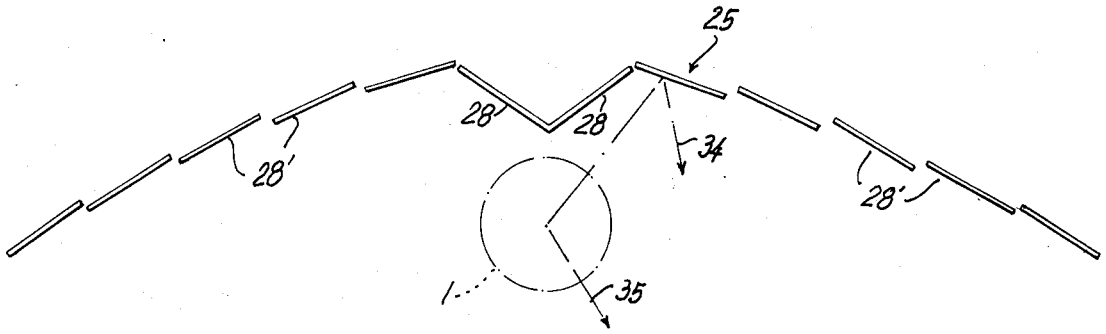
FIG. 5 is a cross sectional representation of the light reflector shown in FIG. 3.
Figure 6:
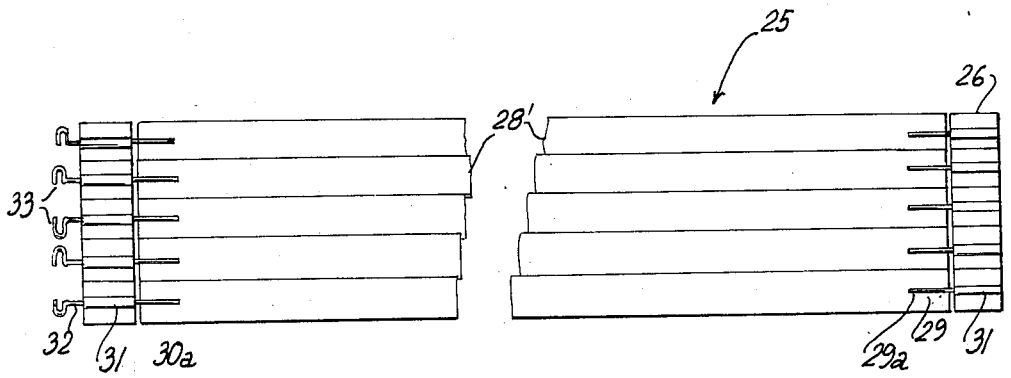
FIG. 6 is a broken side elevational view of the light reflector shown in FIG. 3.

Referring now to the drawings, particularly to the first embodiment of the invention as shown in FIGS. 1 and 2, the light reflector is generally designated by the reference numeral 1. It is shown to comprise a substantially concave element formed from a rigid sheet of light metal or plastic material. The underside of the sheet should be coextensively line with excellent light reflecting material, such as aluminum foil. If the element is made of aluminum or stainless steel, the underside should be glazed or polished.

The concave element comprises a plurality of light reflecting surfaces, such as 12, which are enclined toward and disposed symmetrically of the light source 1. Preferably, there should be five (5) inclined light reflecting surfaces at one side of the light source, indicated by the numerals 12, 14, 15, 16 and 17, and the numerals 18, 19, 20, 21 and 22 for the other side. Connecting the said inclined symmetrical light reflecting surfaces are the opposed tangent light reflecting surfaces 23 and 24 which are disposed at approximately 33 degrees relative to the horizontal.

For ideal lighting requirements, the inclined light reflecting surfaces should approximate the following characteristics:

(a) The outermost surfaces 12, 18 and intermediate surfaces (b) The surfaces 12, 14, 18 and 19 at 40 degrees relative to the horizontal and around 10 mm in width;

(c) The surfaces 15, 16 and 20, 21 at 30 degrees relative to the horizontal and around 14 mm in width, and (d) The surfaces 17 and 22 at 16 degrees relative to the horizontal and 19 mm in width.

The reflector is positioned above the light source 1, at a predetermined distance of about 2 mm, measured from the apex of the opposed tangent surfaces. The reflector is longitudinally coextensive with the light source. Preferably, it may form the bottom wall of the lamp housing 2. The function of the tangent reflecting surfaces is to direct most of the light rays, such as 3, which impinges thereon at an incidence angle towards the area to be lighted and away from the light source.

The second embodiment of the invention which is illustrated in FIGS. 3–6 of the drawings, is generally indicated by the reference numeral 25. It comprises fixed end sections 26 connected by a rigid V-shaped central and longitudinal member 27 which defines the opposed tangent reflecting surfaces 28.

The reflecting surfaces 28 are each pivotally connected to the fixed end sections by elongated pins 29 at one end and 30 at the opposed ends thereof. The ends of the pins 29*a* and 30*a*, respectively, are fixed to the reflecting surfaces. The pins are freely rotatable within the sleeves 31 which are fixedly attached to the fixed end sections 26. The opposed ends 32 of the pins 30 extends through the sleeves 31 and their tips are reversibly bent to form a handle 33 whereby the said pins are rotated. This arrangement permits individual tilting of each of the surfaces to attain the focal axis and the illumination area desired.

To attain incidence angles capable of directing the light towards and within the lateral boundaries of the area to be lighted, the planar reflecting surfaces are individually dimensioned and oriented at varying angles, such angles being subjectively influenced by the height of the light source from the illuminated area, size of the area and the light intensity desired. The illumination pattern produced by the reflector is the sum or superposition of the reflected rays, such as 34, and directly radiated rays, such as 35. This results in maximum illumination.

Although the invention has been described with reference to the preferred embodiments disclosed, it will be apparent to a person skilled in the art that various changes may be made without departing from the spirit and scope of the invention as defined by the appended claims.

I claim:

1. A light reflector for use with an elongated light source comprising:

a substantially M shaped light reflecting element extending in a coaxial parallel longitudinal fashion along a light source, the element having a central V section and at least two wing sections centrally positioned about said central V section;

said central V section includes two opposing tangent light reflecting planar surfaces fixedly joined together to create a V configuration with a centrally positioned apex, said apex being approximately two millimeters above the horizontal axis leading edge of said light source, and said opposing tangent light reflecting planar surfaces being positioned at approximately 33 degrees relative to the horizontal whereby all light rays emitted from said light source impinge on said V section planar surfaces and are reflected away from said light source to prevent light source illumination losses generated by light source interference with reflected light rays; and said two wing sections are symetrically positioned on either side of said V section so as to create said M shape configuration with each wing section having at least five individually dimensioned and oriented light reflective angled planar surfaces with widths in the range of 10 to 20 millimeters, said light reflective angled planar surfaces being inclined at angles in the range of 16 to 40 degrees relative to the horizontal, said wing section surfaces being positioned such that the widest are adjacent to said V section while the narrowest surfaces form the farthest portion of said wing sections from said V section whereby light rays emitted from said light source illuminate a predetermined area in a substantially glare-free manner.

2. A light reflector according to claim 1 wherein each of said planar surfaces are fixedly positioned about said V section and include a first planar surface of each wing section closest to the V section which is approximately 19 millimeters wide and inclined at an angle of approximately 16 degrees relative to the horizontal, a pair of second and third planar surfaces of each wing section closest to said first planar surface which are approximately 14 millimeters wide and are inclined at angles of approximately 30 degrees relative to the horizontal, and a pair of fourth and fifth planar surfaces of each wing section closest to said third planar surface which are approximately 10 millimeters wide and inclined at angles of approximately 40 degrees relative to the horizontal.

3. A light reflector according to claim 1 further including tilting means joined to said wing section planar surfaces for individually tilting and adjusting said surfaces and the incidence angles of the light rays impinging thereon.

4. A light reflector according to claim 3 wherein a first planar surface closest to said V section in each wing section is approximately 19 millimeters wide, a pair of second and third planar surfaces closest to said first planar surface of each wing section being approximately 14 millimeters wide, and a pair of fourth and fifth planar surfaces closest to said third planar surface in said wing sections being approximately 10 millimeters wide.

5. A light reflector according to claim 1 wherein said reflective planar surfaces are lined with aluminum foil.

6. A light reflector according to claim 2 wherein said reflective planar surfaces are lined with aluminum foil.

7. A light reflector according to claim 4 wherein said reflective planar surfaces are lined with aluminum foil.

* * * * *